US006276010B1

(12) United States Patent
Way et al.

(10) Patent No.: US 6,276,010 B1
(45) Date of Patent: Aug. 21, 2001

(54) STEPPED LOCKING PIN

(75) Inventors: Christopher B. Way, Richland; Clifford E. Lambarth, Portage, both of MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 09/455,092

(22) Filed: Dec. 6, 1999

(51) Int. Cl.[7] ..... A61G 1/00
(52) U.S. Cl. ..... 5/611; 5/11
(58) Field of Search ..... 5/600, 625, 627, 5/111, 620, 11; 280/639, 647, 649; 296/19, 20, 611

(56) References Cited

U.S. PATENT DOCUMENTS 5,365,622 * 11/1994 Schirmer ..... 5/611
5,432,966 * 7/1995 Berta et al. ..... 5/611

* cited by examiner

*Primary Examiner*—Lynne H. Browne
*Assistant Examiner*—Fredrick Conley
(74) *Attorney, Agent, or Firm*—Flynn, Thiel, Boutell & Tanis, P.C.

(57) ABSTRACT

An ambulance cot having a wheeled base, a horizontally oriented patient litter support disposed on the base and having an elongate guide extending lengthwise thereof. A support mechanism is provided for supporting the patient litter support for vertical movement relative to the base while being maintained in the generally horizontal orientation. A device is provided for selectively locking the patient litter support at selectively different vertical elevations.

7 Claims, 20 Drawing Sheets

STEPPED LOCKING PIN

FIELD OF THE INVENTION

This invention relates to an emergency vehicle cot which can be loaded into an emergency vehicle and, more particularly, to such an emergency vehicle cot with an improved support and locking mechanism.

BACKGROUND OF THE INVENTION

Emergency vehicle cots (also known as ambulance cots) are specialized stretchers usually used in association with emergency vehicles. The ambulance cot is deemed to be specialized due to it being capable of easy loading into the emergency vehicle, namely, the wheeled base and support structure are collapsible as the cot is moved into the inside of the emergency vehicle to facilitate ambulance personnel to work on the patient lying on the cot in the fairly limited space inside the emergency vehicle. Although preexisting ambulance cots have been generally adequate for their intended purposes, they have not been satisfactory in all respects.

One exception to the aforesaid statement is the emergency vehicle cot disclosed in pending application Ser. No. 09/102 143, filed on Jun. 22, 1999, assigned to the same assignee as is the present application. This emergency vehicle cot, however, requires the synchronized operation of a lifting procedure and an operation of the handles located at opposite ends of the cot by the emergency personnel in order to effect a vertical adjustment of the elevation of the patient supporting surface between the "load position" and positions oriented therebelow. Oftentimes, and in emergency situations, the two emergency personnel do not always lift and operate the handles in synchronization and, as a result, the mechanism automatically resets and it becomes awkward and time consuming to effect a new operation to effect a movement of the patient supporting surface to levels oriented between the "load position" and the lowestmost or folded position. As is explained in the aforesaid pending application, if the attempt to adjust the vertical height of the patient supporting surface is attempted with both emergency personnel not being synchronized in their lifting and handle operation technique, the emergency personnel's operation of the handle at the foot end of the cot without the simultaneous operation of the other handle by the emergency personnel at the head end of the cot will cause, when the handle at the foot end is released, a safety control mechanism to rest to prevent any single handle from enabling the level of the patient supporting surface to be altered. Thus, it is desirable for there to be provided a mechanism which assures the emergency personnel that an altering of the height of the patient supporting surface can effectively take place only when both ends of the cot are sufficiently supported so as to not jeopardize the safety of the patient supported on the patient supporting surface.

Accordingly, it is an object of the present invention to provide an ambulance cot with an improved support mechanism with a safety mechanism which prevents a release of the locking mechanism for the vertical height adjustment unless both ends of the emergency cot are lifted and, therefore, supported by emergency personnel. A control mechanism is purposefully moved to the activated state to enable the emergency personnel to lift while one of them sets the safety mechanism for release and thereafter both of them initiate a safe and controlled raising or lowering of the patient supporting surface.

It is a further object of the invention to provide a control mechanism on the ambulance cot, as aforesaid, for preventing inadvertent collapsing of the support mechanism when the support mechanism is in its highest most position, known in the field as the "load position".

It is a further object of the invention to provide an ambulance cot, as aforesaid, and a control mechanism, as aforesaid, which must be activated to enable the support mechanism to be released from its "load position" to allow the base to collapse toward the patient litter support to enable insertion of the ambulance cot easily into the emergency vehicle.

It is a further object of the invention to provide a control mechanism, as aforesaid, which is movable between activated and inactive states only when the ambulance cot is in the load position and which, in the activated state, permits a load process to begin by manual operation of only one handle, and which automatically resets to an inactive state upon a manual operation of the handle so that an abort of the load process caused by a release of the handle will always necessitate a reactivation of the control mechanism to enable the support mechanism to be released from its load position to allow the base to collapse toward the patient litter support mechanism to enable insertion of the now fully folded ambulance cot easily into the emergency vehicle.

It is a further object of the invention to provide a control mechanism, as aforesaid, which, when moved to an activated state, permits a lowering of the ambulance cot from the load position to positions below the load position only in response to a lifting of both ends of a sufficient amount to reduce a majority of the load on the wheels and a simultaneous manual operation of one handle of the release mechanism oriented at one of the ends of the ambulance cot.

It is a further object of the invention to provide an ambulance cot, as aforesaid, wherein the control mechanism requires the attendance of two emergency personnel in order to effect movements of the support mechanism and the patient litter support thereon to positions intermediate the load position and the folded position.

SUMMARY OF THE INVENTION

The objects and purposes of the invention, including those set forth above, are met by providing an ambulance cot having an upper frame forming a bed having a head end and a foot end, a lower frame with wheels being supported on the lower frame. Forward and rearward vertical legs are connected to the upper frame and to the lower frame with the lower frame being approximately centered below the upper frame. At least one longitudinal beam is supported on the upper frame and has a slide slidably mounted on the beam and pivotally connected to the upper end of the front legs. An upper end of the rear legs is pivotally mounted on the upper frame. A locking mechanism is provided for releasably and selectively locking the front slide in selected longitudinal positions on the beam to adjust the positions of the upper frame with respect to the lower frame. The locking mechanism includes at least one locking pin slidably mounted in said front slide, a spring urging the at least one pin toward the at least one beam, stops on the at least one beam engageable by the at least one locking pin to position the upper ends of said front legs in selected positions. A longitudinal release bar is mounted by pivoted arms to the upper frame. The release bar is movable laterally when pulled longitudinally to engage with the pin to effect withdrawal of said pin from the stops. The pin has a catch thereon configured to normally engage the stop to block withdrawal of the pin from the stop when the bar is pulled longitudinally.

BRIEF DESCRIPTION OF THE DRAWINGS

Preferred embodiments of the present invention will be described in detail hereinafter with reference to the accompanying drawings, in which.

DETAILED DESCRIPTION

The invention disclosed herein is set forth in detail in the section of the text captioned ALTERNATE CONSTRUCTION. The following disclosure is taken from application Ser. No. 09/102 143, assigned to the same assignee as is the present invention and provides background information for the invention.

Figure 1:
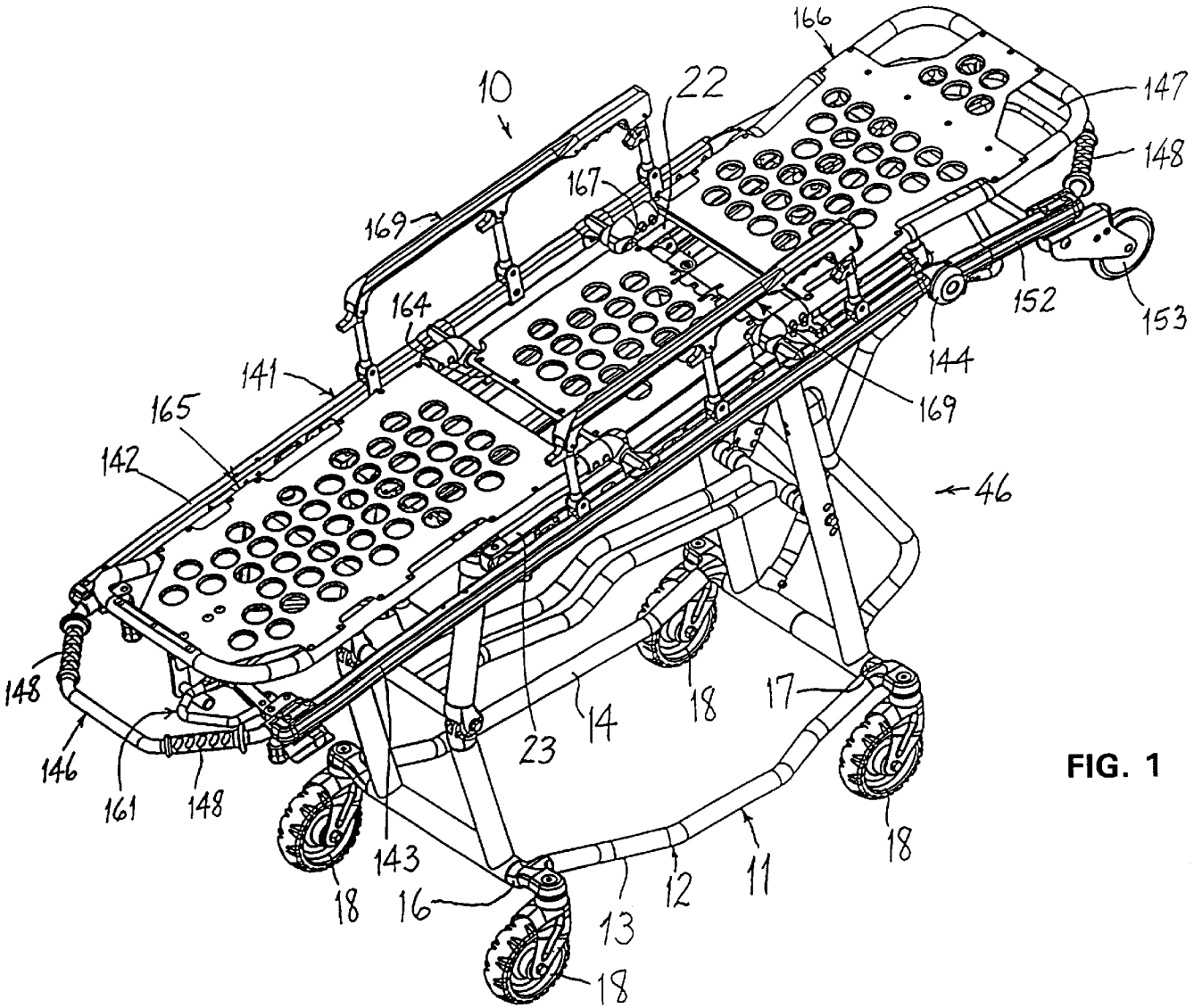
FIG. 1 is an isometric view of an ambulance cot embodying the invention.
Figure 2:
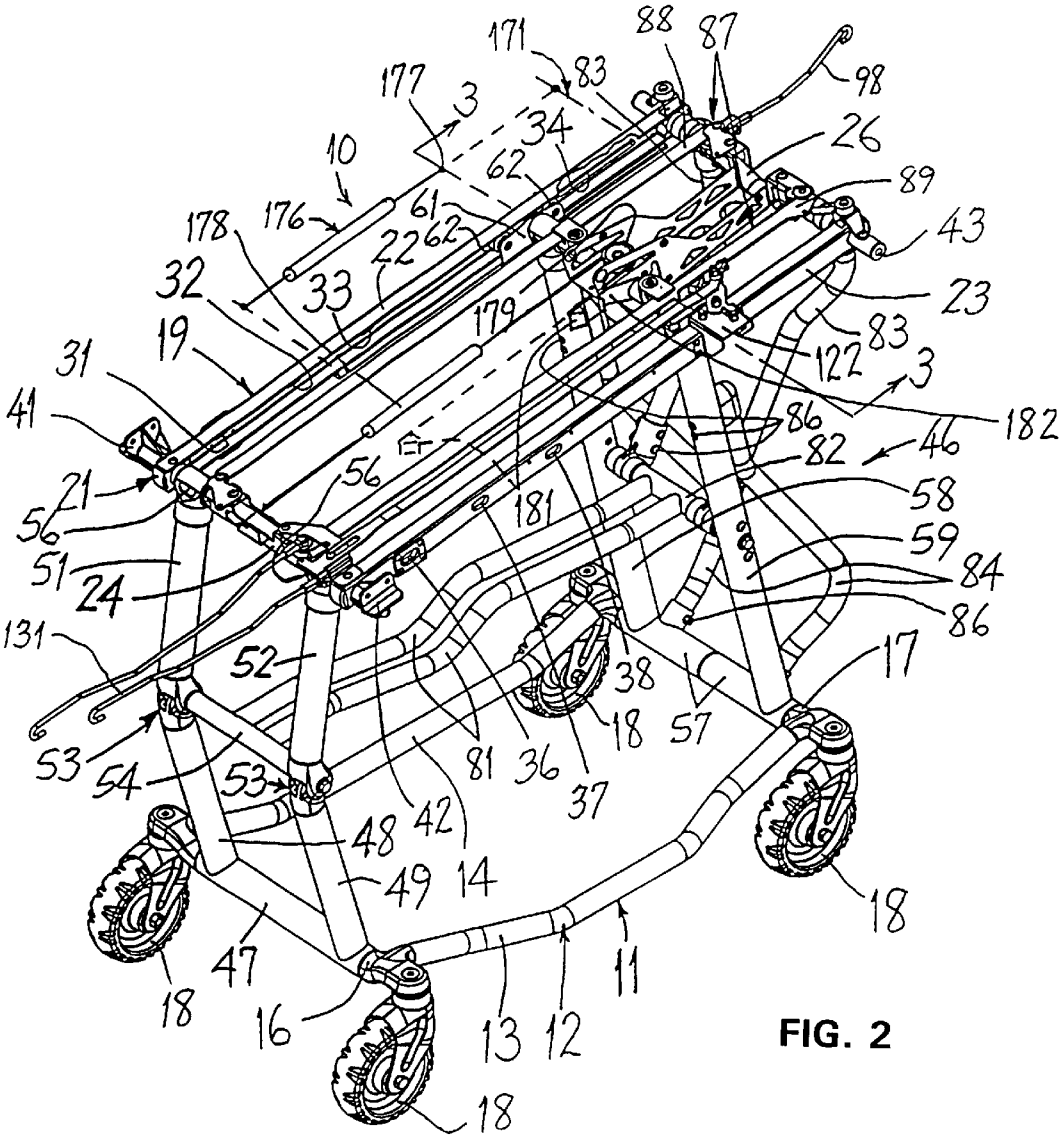
FIG. 2 is an isometric view of the support mechanism which interconnects the patient litter support with the wheeled base.

An ambulance cot 10 embodying the invention is illustrated in the drawings. As shown in FIGS. 1 and 2, the ambulance cot 10 includes a wheeled base 11 having a rectangular frame 12 composed of side frame members 13 and 14 and end frame members 16 and 17. For purposes of this discussion, the left end of the ambulance cot illustrated in FIG. 1 is deemed to be the foot end and the right end of the ambulance cot is deemed to be the head end. Further, a movement of the ambulance cot on the four castered wheels 18 located at the four corners of the rectangular frame 12 to the left will be deemed a rearward movement and a movement to the right a forward movement. The frame member 16 at the foot end of the wheeled base 11 defines a transversely extending axle and, similarly, the frame member 17 at the head end of the wheeled base defines a further transversely extending axle.

Figure 3:
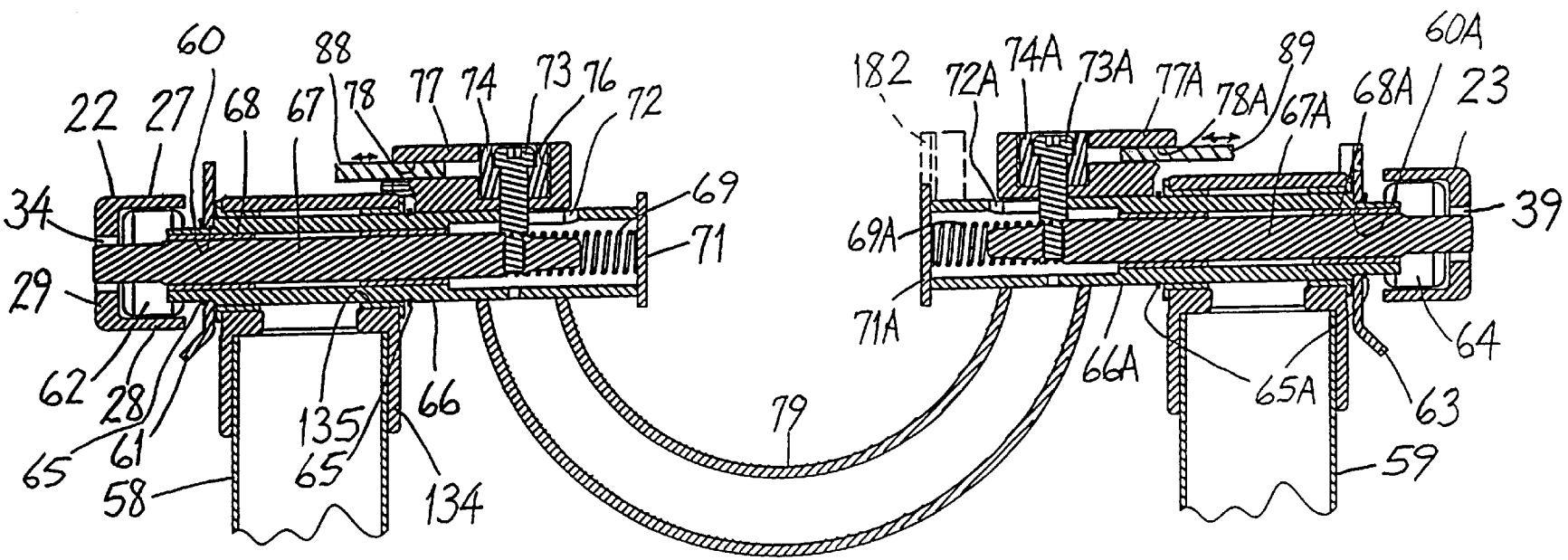
FIG. 3 is a sectional view taken along the line 3—3 of FIG. 2.

The ambulance cot includes a patient litter support structure 19 (FIG. 2). The patient litter support 19 includes a rectangular frame 21 consisting of elongate side members 22 and 23 and elongate laterally extending members 24 and 26 at the foot and head end portions. The foot and head end frame members 24 and 26 also define transversely extending axles parallel to the axles 16 and 17. The side frame members 22 and 23 are each C-shaped channels (see FIG. 3). The C-shaped channel 22 includes a top wall 27, a bottom wall 28 parallel to the top wall 27 and a sidewall 29 interconnecting the top and bottom walls 27 and 28 along an outboard edge of the aforesaid top and bottom walls. A plurality of apertures 31, 32 and 33 are provided along the length of the side frame member 22. An additional elongated slot 34 is also provided in the side frame member 22 (FIG. 2) ahead of the aperture 33. Similarly, a plurality of apertures 36, 37, 38 and 39 are provided in the sidewall of the C-shaped side frame member 23. The aperture 39 is illustrated in FIG. 3 (not FIG. 2) and is axially aligned with the rearward most end of the elongate slot 34 in the side frame member 22. The apertures 31, 32 and 33 are axially aligned with, and respectively, the apertures 36, 37 and 38.

A support bracket 41 and 42 is provided on each end of the foot end axle 24 of the frame 21. Opposite ends of the axle 26 at the head end of the frame 21 have openings in the end thereof to facilitate reception of a fastener. Only the opening 43 is shown in FIG. 2.

A support mechanism 46 is oriented intermediate the wheeled base 11 and the patient litter support structure 19. The support mechanism 46 includes, at the foot end thereof, an elongate section of pipe 47 sleeved over the outside of the axle 16 so that the pipe 47 can rotate about the axis of the axle 16. Secured to the pipe 47 are two leg parts 48 and 49 fixedly secured to and movable with the pipe 47. The leg parts 48 and 49 are secured to the pipe 47 as by welding. Two additional leg parts 51 and 52 are respectively pivotally connected as at 53 to the leg parts 48 and 49 by an axle 54. The ends of the legs 51 and 52 remote from the axle 54 are pivotally connected as at 56 to the axle defining frame member 24 of the frame 21 of the patient litter support structure 19.

At the head end of the support mechanism 46, there is provided a pair of pipe sections 57 sleeved over the outside of the axle 17 and are rotatable relative to the axle 17. A leg part 58 is secured to one pipe section 57 and a further leg part 59 is secured to the other pipe section 59. In this particular embodiment, the parts 58 and 59 are each weldably secured to the respective pipe section 57 and movable therewith. The upper ends of the leg 58 terminate in a casting 134 having a laterally extending hole 135 therethrough. A wheel supporting bracket 61 having thereon lengthwise spaced apart wheels 62 is mounted, as explained below, to the casting 134. The wheels 62 are received between the top and bottom walls 27 and 28 of the C-shaped side frame member 22 as illustrated in FIG. 3. Similarly, the upper end of the leg part 59 terminates in a casting 136 having a laterally extending hole 137 therethrough. A wheel supporting bracket 63 mounted, as explained below, to the casting 136 rotatably supports thereon lengthwise spaced apart wheels 64. The wheels are received between the top and bottom walls of the C-shaped side frame member 23 as also illustrated in FIG. 3.

A hollow sleeve 66 is rotatably supported in the hole 135 in the casting 134. The bracket 61 (FIG. 3) has a hole 60 therethrough which receives therein one end of the hollow sleeve 66. Both the bracket 61 and the hollow sleeve 66 are appropriately blocked from relative axial movement relative to the casting 134 by spring clips 65. The hollow sleeve 66 also houses therein for reciprocal movement a pin 67. Conventional bushings 68 are provided which slidingly support the pin 67 for reciprocal movement inside the sleeve 66. A spring 69 is interposed between a spring abutment member 71 secured to the inboard end of the sleeve 66 and the inboard end of the pin 67 to urge the pin 67 leftwardly into a selected aperture 31–34 provided in the C-shaped frame member 22. An elongate slot 72 is provided in the upper segment of the sleeve 66 and through which extends a peg 73 fixedly secured to and movable with the pin 67. The peg 73 rotatably supports a wheel 74 which in turn is mounted in a pocket 76 of a guide member 77. The guide member 77 has a laterally opening slot 78 into which is received a part of a control mechanism which will be described in more detail below. An identical hollow sleeve construction is provided at the upper end of the leg part 59 and, as a result, a detailed description of the individual components is believed unnecessary. However, the same reference numeral followed by the suffix "A" has been shown in FIG. 3 to designate the components that effect an urging of the reciprocal pin 67A rightwardly into an appropriately aligned aperture in the sidewall of the C-shaped frame member 23.

The sleeves 66 and 66A are interconnected by an arcuately shaped yoke 79 in order to cause the leg parts 58 and 59 to move together and to maintain axial alignment of the reciprocating pins 67 and 67A.

In summary, therefore, the C-shaped side frame members 22 and 23 each define a guide into which is received a slide mechanism defined by the wheels 62 and 64 on the respective brackets 61 and 63. A movement of each pin 67 and 67A toward one another, that is, toward the centerline of the ambulance cot 10, will effect a withdrawal of the pins from an associated aperture to enable the upper ends of the leg parts 58 and 59 to move relative to the side frame members 22 and 23. A detailed discussion of how this is accomplished is set forth below.

A pair of parallel link members 81 are fixedly connected at the foot end thereof to the axle 54. A further axle 82 is connected to and extends between the midlength portions of each of the leg parts 58 and 59. The link members 81, at the head end thereof, are fixedly connected to the axle 82. The leg parts 48 and 49 at the foot end are maintained in parallel relation to the leg parts 58 and 59 by the link members 81. A further pair of parallel link members 83 are replaceably connected at one end thereof to the axle 82 and extend to and are respectively connected to the axle 26 at the head end of the frame 21 of the patient litter support structure 19. A pair of parallel bumper members 84 are replaceably connected to the respective pipe part 57 at one end thereof and to the respective leg part 58 intermediate the axle 82 and the interconnected sleeves 66, 66A and yoke 79. The removable connection feature for both members 83 and 84 is accomplished by conventional screws and nuts and bolts schematically illustrated as at 86. In this particular embodiment, the link members 83 and the bumper members 84 are each composed of an interior metal tube member coated or encircled by a tough bearing grade resin such as an ultra high molecular weight polyethylene to enable the members to withstand substantial striking engagements with exterior body components of the emergency vehicle as the ambulance cot 10 is urged into the interior of the emergency vehicle. As a result, when sufficient damage has been subjected to the link members 83 and the bumper members 84, they can be simply removed and replaced with new link members and new bumper members. The fasteners 86 are each easily removable thereby rendering the aforesaid repair simple and quick.

Figure 12:
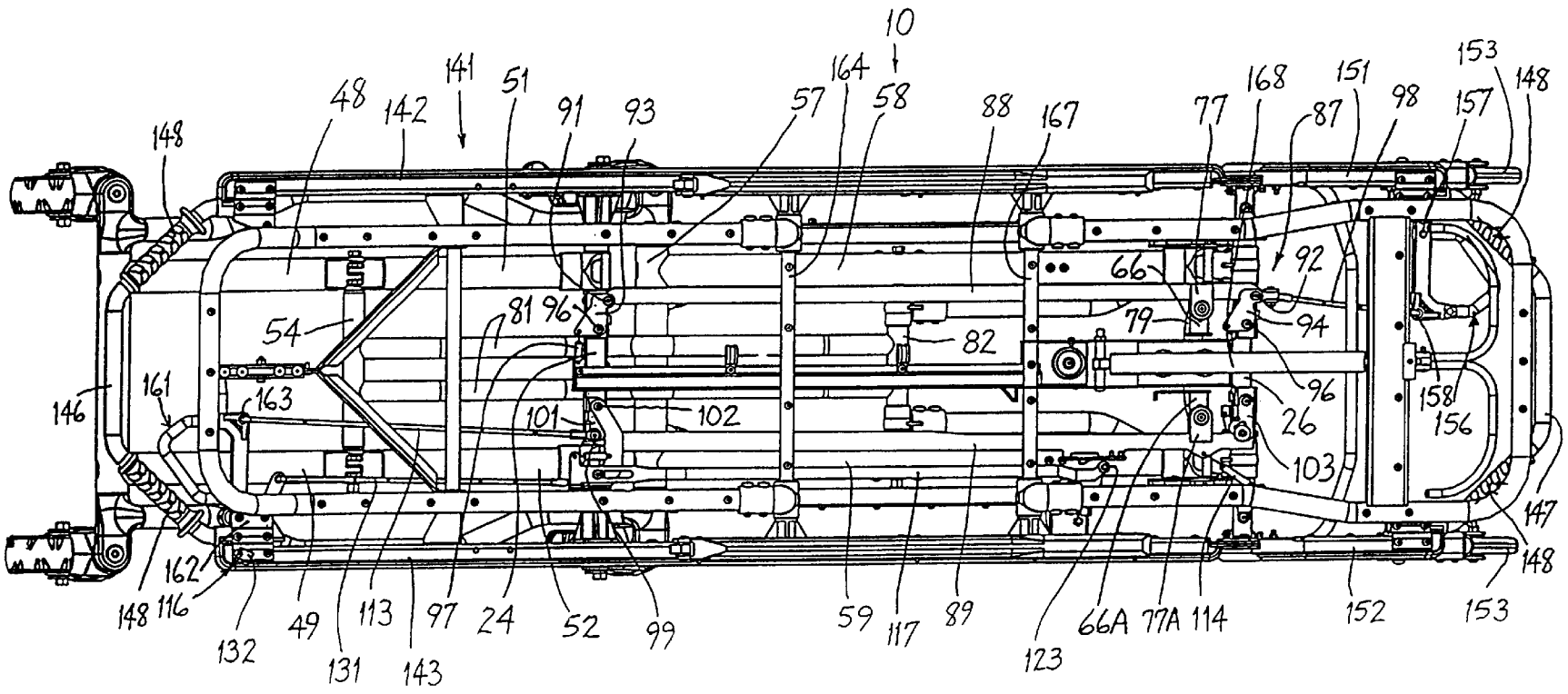
FIG. 12 is a top view of the ambulance cot illustrated in FIG. 11.

A control mechanism 87 is provided on the patient litter support mechanism 19 for controlling the operation of the reciprocal pins 67 and 67A. The control mechanism 87 includes a pair of generally parallel lengthwise shiftable elongate bars 88 and 89. Referring to FIG. 12, the elongate bar 88 is pivotally secured at both the foot end and head end thereof as at 91 and 92, respectively, to brackets 93 and 94 each pivotally secured as at 96 to the respective axle member 24 and 26. Several schematically illustrated springs 97 are provided for effecting a return movement of the pivotal brackets 93 and 94 to the initial position illustrated in FIG. 12. The bracket 94 has a link chain-like member 98 secured thereto so that when the chain is placed under tension, the brackets 93 and 94 interconnected by the elongate bar 88 will be both pivoted about their respective pivot axes 96 in a clockwise direction thereby causing a movement of the bar toward the central longitudinal axis of the ambulance cot 10. Referring to FIG. 3, a rightward movement of the elongate bar 88 will cause it to engage the exterior surface of the wheel 74 thereby effecting a movement through the peg 73 of the pin 67 to the right and a retraction thereof from the associated aperture 31–34. When the tension on the chain 98 is removed, the aforesaid springs 97 will effect a return of the brackets 93 and 94 to their original position and a movement of the elongate bar to its original position illustrated in FIG. 3. The spring 69 will urge the pin 67 leftwardly and into an aligned aperture 31–34.

Figure 5:
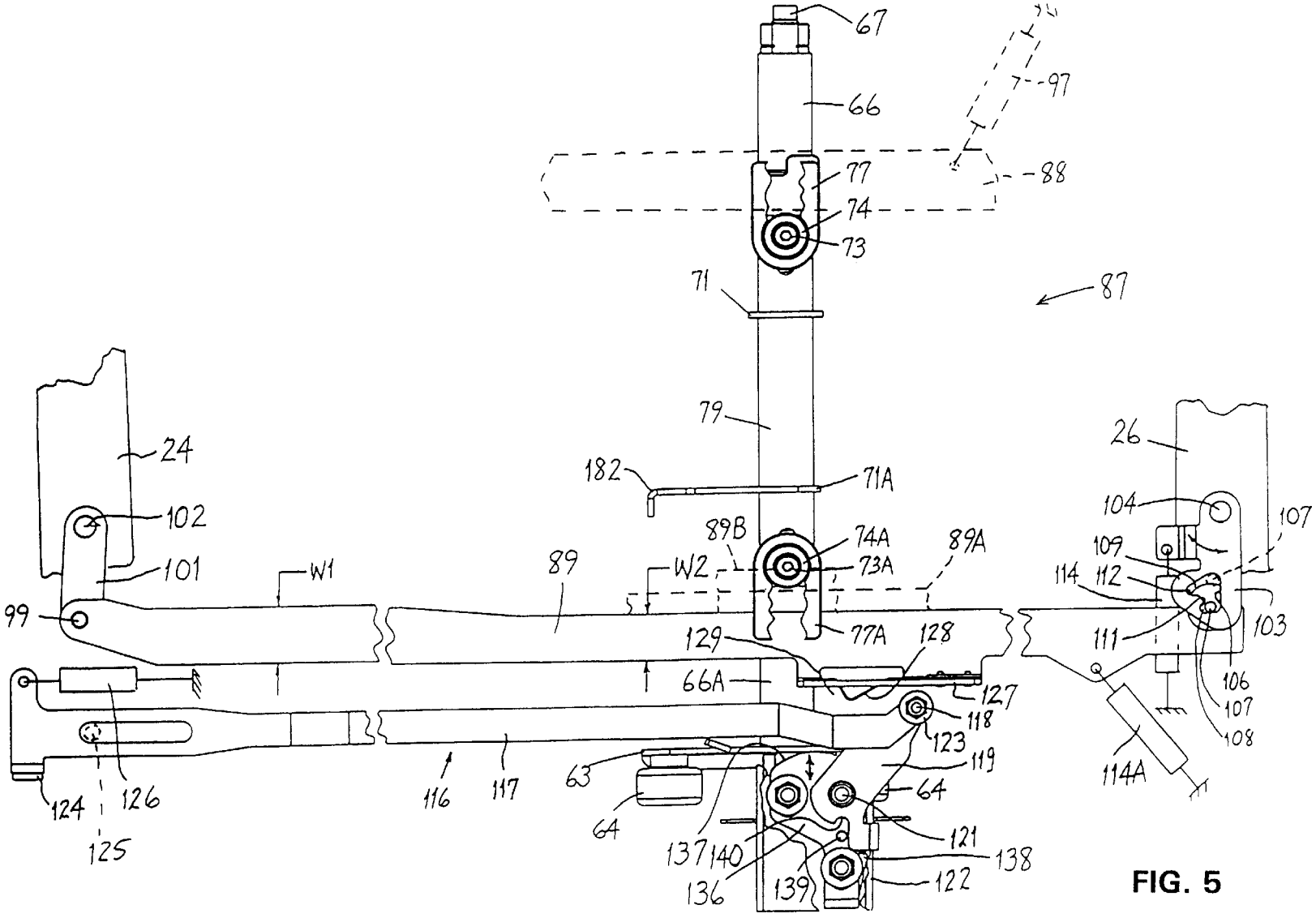
FIG. 5 is a fragment of a control mechanism provided on the support mechanism.

The elongate bar 89 is controlled in a similar manner, but from construction oriented at the foot end. More specifically, and referring to FIG. 12, the elongate bar 89 is pivotally connected as at 99 to a link 101 which in turn is pivotally connected to the axle 24 as at 102. As is also shown in FIG. 5, the head end of the elongate bar 89 is connected to a bracket 103 which in turn is pivotally connected as at 104 to the axle 26. The bracket 103 has a specially configured opening 106 therein as is best shown in FIG. 5. A peg 107 is secured to the head end of the elongate bar 89 and is received in the opening 106. The opening 106 is configured somewhat like the letter U with the legs of the U being of different lengths. For example, and referring to FIG. 5, the peg 107 is illustrated in the short leg 108 of the U-opening, which short leg is, in this particular embodiment, spaced further from the axis of the pivot 104 than is the long leg 109 of the opening 106. The short leg 108 of the opening 106 terminates in an abutment surface 111. Similarly, the long leg 109 of the opening 106 terminates in an abutment surface 112. An elongate chain-like member 113 is secured to the pivot 99 at the foot end of the elongate bar 89. When the chain-like member 113 is tensioned, the elongate bar 89 will be urged to the left and both brackets 101 and 103 will be pivoted clockwise about their respective pivot axes 102 and 104 to cause the peg 107 to move into engagement with the abutment surface 111 and effect a corresponding movement of the elongate bar 89 to the broken line position illustrated in FIG. 5, namely, a movement that is toward the longitudinal centerline of the ambulance cot 10. Referring to FIG. 3, a movement of the elongate bar 89 to the left will cause it to engage the exterior surface of the wheel 74A to cause a transmission of force through the peg 73A to the reciprocal pin 67A to cause the pin 67A to be retracted from the corresponding aperture 36–38. In order for the elongate bar 89, due to a variable width characteristic described below, to be able to retract the pin 67A from the aperture 39, a secondary control mechanism 116 described below is required.

As is illustrated in both of FIGS. 5 and 12, the width of the elongate bar 89 varies along the length thereof. Adjacent the foot end, the elongate bar 89 has a width W1 and adjacent the head end thereof, the elongate bar 89 has a width W2. This feature is important when the sleeves 66 and 66A and the interconnecting yoke 79 are in the position illustrated 35 in FIG. 5, namely, when the ambulance cot is in the load position illustrated in FIGS. 1 and 9. In this position, when the peg 107 engages the abutment surface 111 in response to a tensioning of the chain 113 to cause a lengthwise movement of the elongate bar 89 to the left thereby causing both brackets 101 and 103 to pivot in a clockwise direction about their respective axes 102 and 104, the movement of the elongate bar 89 to the broken line position 89A illustrated in FIG. 5 will be insufficient to cause engagement of the elongate bar 89 with the wheel 74A. As a result, the movement will be insufficient to effect a withdrawal of the reciprocal pin 67A from the aperture 39 corresponding to the load position of the ambulance cot.

In order to effect a removal of the reciprocal pin 67A from the aperture 39, an additional component of the control mechanism 87 is required, that additional component being a secondary control mechanism indicated by the reference numeral 116 in FIG. 5. More specifically, the secondary control mechanism 116 includes an elongate bar 117 pivotally connected as at 118 to a bracket 119 which is, in turn, pivotally connected as at 121 to a bracket 122 mounted on the side frame member 23. A wheel 123 is rotatably supported by the pivot joint 118. The foot end of the elongate bar 117 terminates in a bracket 124 having an elongate slot which receives therein a pin 125 fixed to the elongate member 24 and includes a spring 126 causing the elongate bar 117 to be continually urged to the right in FIGS. 5–8 and the bracket 119 to be continually urged about its support pivot 121 in a clockwise direction.

Figure 7:
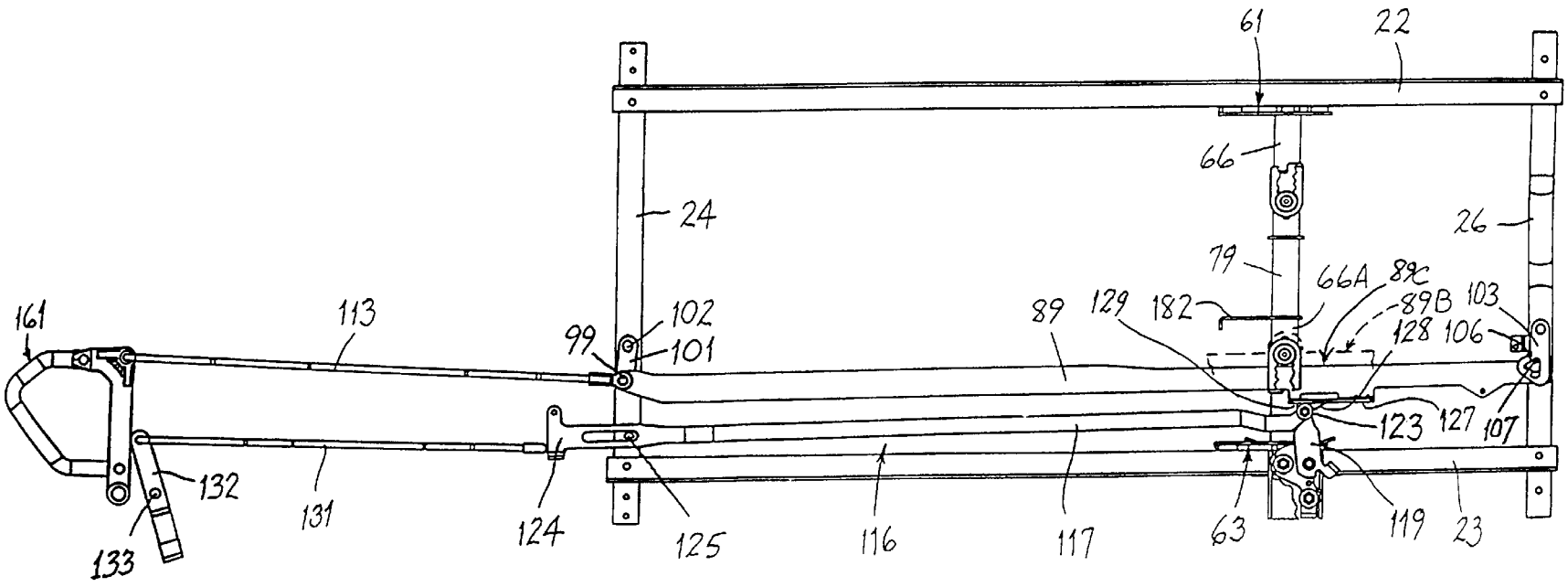
FIG. 7 is a top view of the control mechanism similar to FIG. 6, but wherein the control mechanism is in a second position to facilitate a collapsing of the support mechanism.

The elongate bar 89 includes an abutment surface 127 opposing the wheel 123 on the additional control mechanism 116. The opposing surface 127 includes a ramp 128 which is engaged by the wheel 123 to urge the elongate bar 89 toward the longitudinal central axis of the ambulance cot 10 against the urging of the return spring 114A. Referring to FIG. 7, the wheel moves to a position 129 to the left of the left end of the ramp 128 so that the wheel 123 applies pressure to the abutment surface 127 to urge it and the connected elongate bar 89 to the broken line position 89C illustrated in FIG. 7. In this shifted position of the elongate bar 89, it will be noted that the peg 107 in the opening 106 has been shifted into alignment with the long leg 109 of the U-shaped opening 106, namely, to the broken line position illustrated in FIG. 5. Since the elongate bar 89 has now been moved into closer relation to the wheel 74A, a leftward movement of the elongate bar 89 will cause the peg 107 to traverse the long leg 109 of the opening 106 and to come into engagement with the abutment surface 112 thereby causing further movement of the elongate bar 89 toward the central longitudinal axis of the ambulance cot 10 to the position 89B in FIG. 5 so as to effect a retraction of the reciprocal pin 67A from the aperture 39.

As is illustrated in FIG. 7, an elongate chain 131 is connected to the bracket 124 at one end and is connected to a manually engageable handle 132 at the other end, the handle being pivotal about a pivot axis 133. A pivoting of the handle 132 in a counterclockwise direction will cause a tensioning of the chain 131 and a consequent shifting of the elongate bar 117 to the left thereby causing a counterclockwise movement of the bracket 119 and a corresponding movement of the wheel 123 to the position 129 illustrated in FIG. 5.

Figure 6:
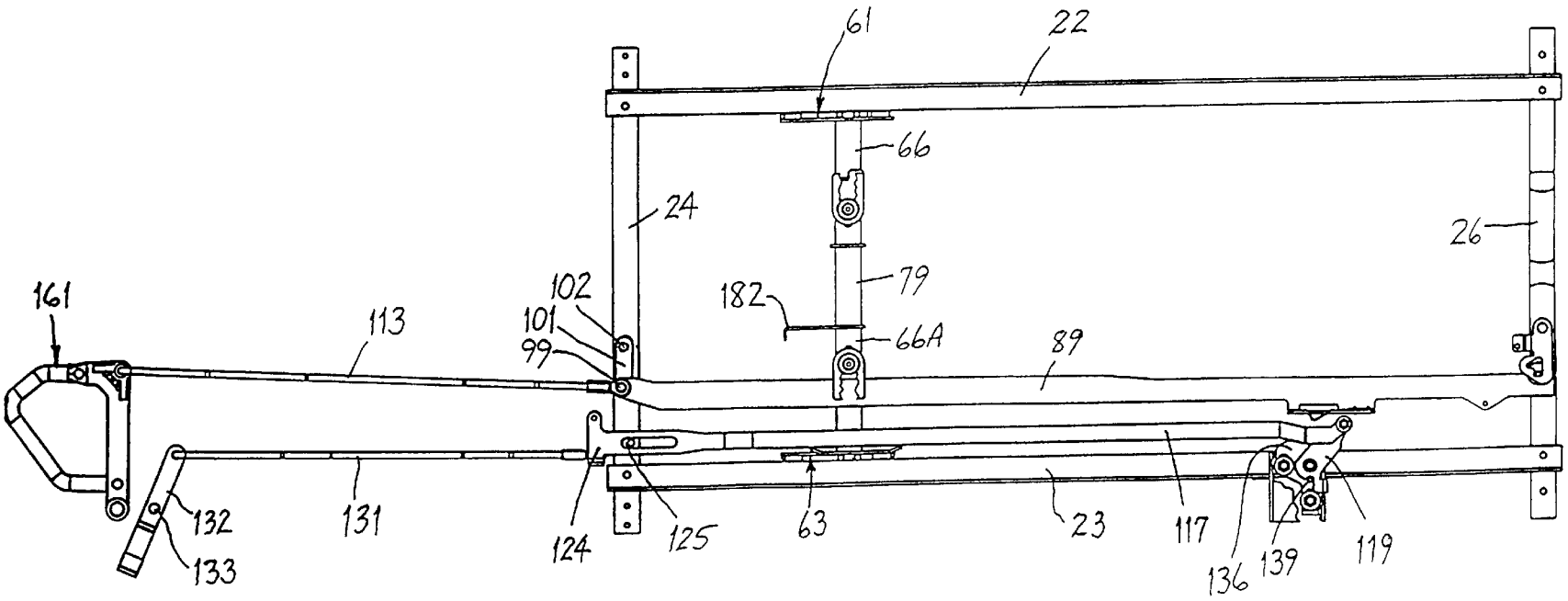
FIG. 6 is an enlarged portion of the control mechanism illustrated in FIG. 5 and in a first position thereof.
Figure 8:
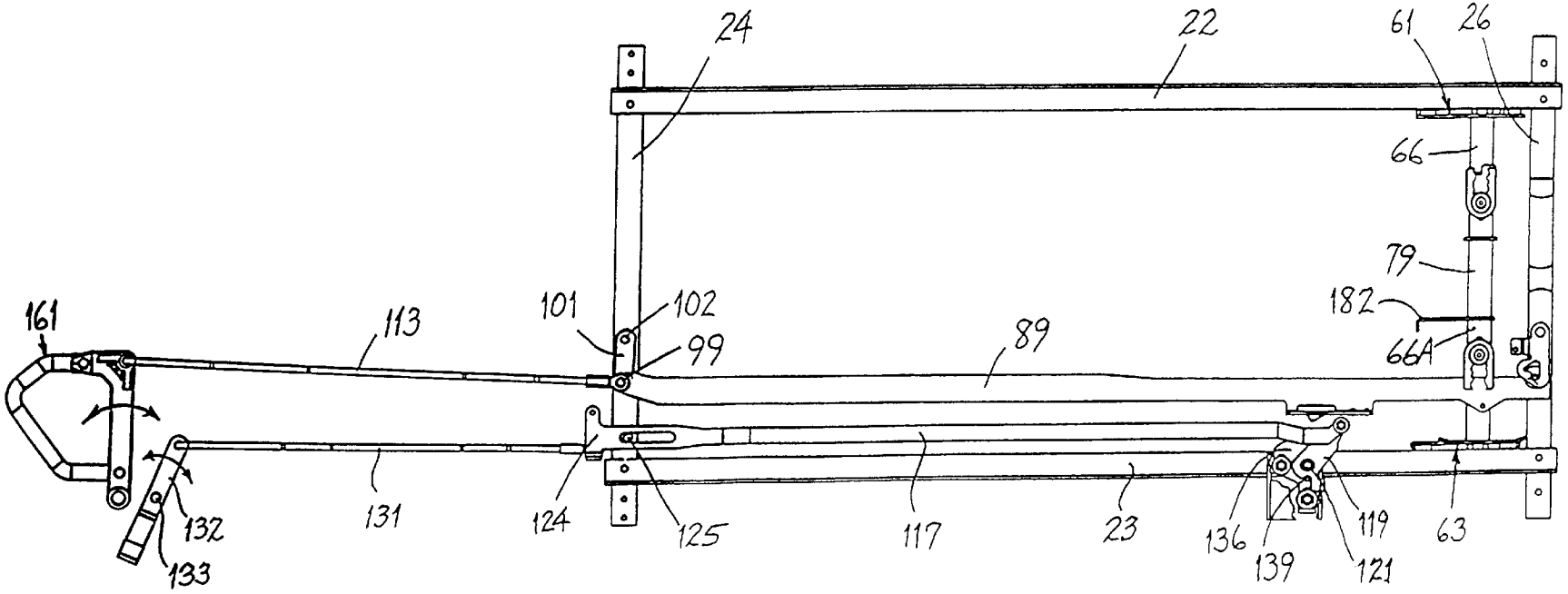
FIG. 8 is a top view similar to FIG. 7, but with the support mechanism being in the folded position.
Figure 9:
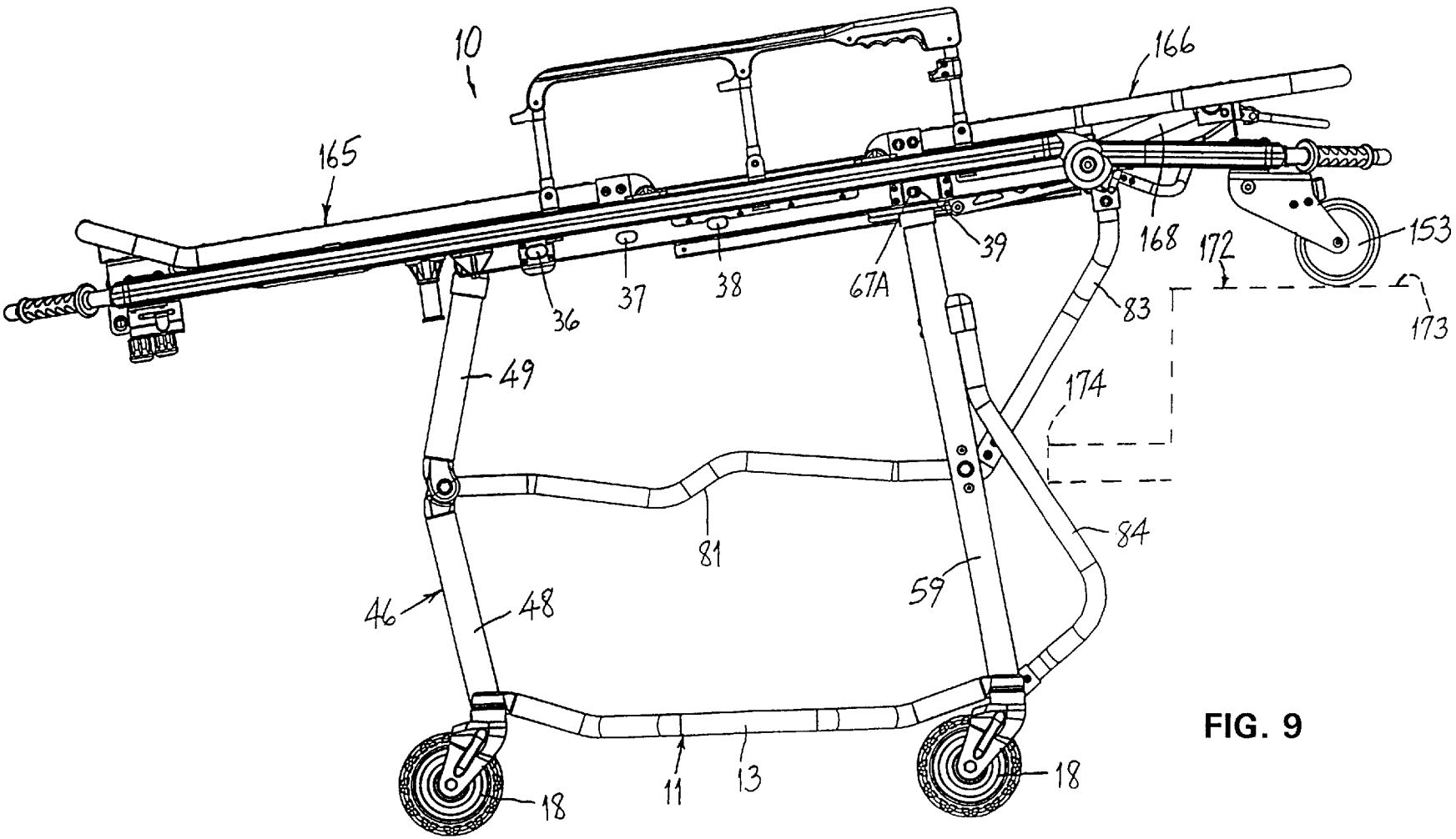
FIG. 9 is a side view of the ambulance cot in the transport position.
Figure 10:
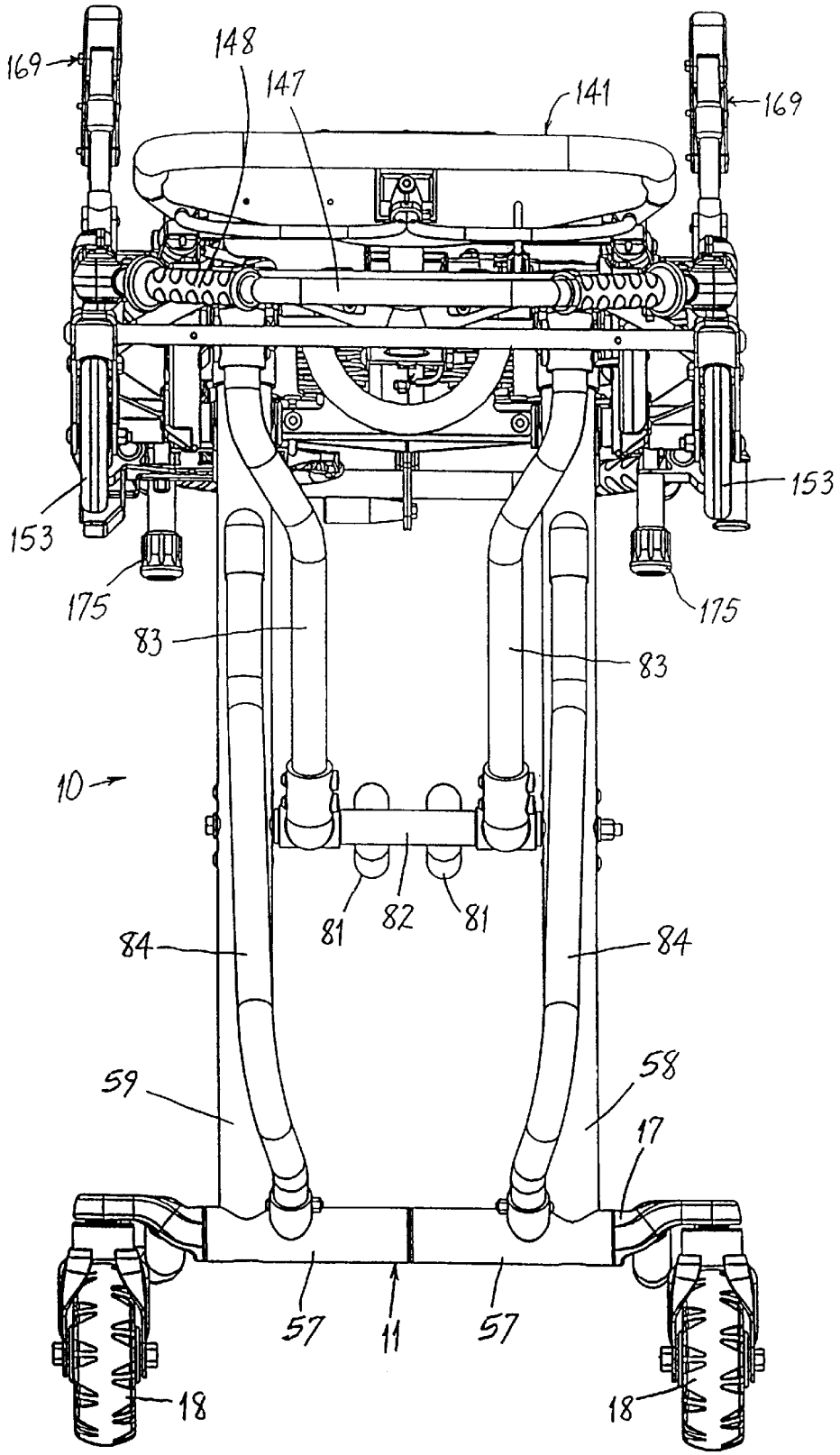
FIG. 10 is a right end view of the ambulance cot illustrated in FIG. 9.

The handle 132 can be pivoted in a counterclockwise direction only when the sleeves 66 and 66A and interconnecting yoke 79 are in the load position of the cot 10 shown in FIGS. 5 and 9. More specifically, a laterally reciprocal plate 136 is provided which is engaged along an arcuate edge 137 by the bracket 63 to urge the plate 136 away from the central longitudinal axis of the cot to the position illustrated in FIG. 5 against the urging of a spring 138. A peg 139 is carried by the plate 136 and its position shifts so as to not interfere with the movement of the bracket 119. However, when the sleeves 66 and 66A and yoke 79 move to other positions relative to the aforementioned plate 136, such as the positions shown in FIGS. 6 and 8, corresponding to the positions of the cot 10 shown in FIGS. 14 and 11 respectively, the spring 139 will cause the plate 136 to shift toward the central longitudinal axis of the cot to cause the peg 139 to enter a notch 140 in the bracket 119, as shown in FIGS. 6 and 8, to prevent pivotal movement of the bracket 119 and, consequently, prevent movement of the handle 132. This safety feature prevents an activation of the handle 132 when the position of the patient litter support structure 19 is in any one of the folded and partially collapsed positions of the support mechanism 46 shown in FIGS. 11 and 13–15.

Figure 4:
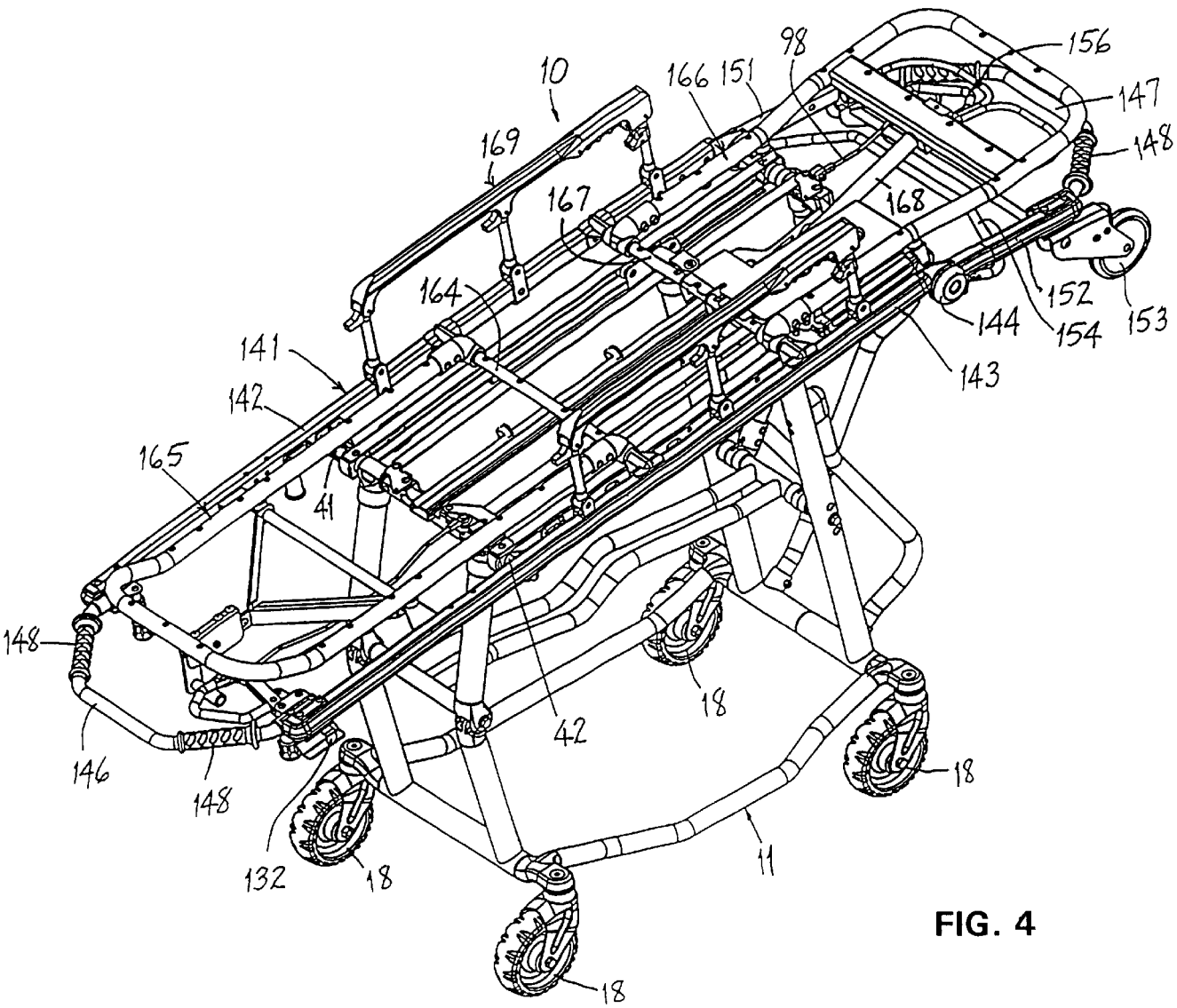
FIG. 4 is an isometric view similar to FIG. 1, but with portions of the patient litter being removed to facilitate a better presentation of the structure.

A patient litter 141 is mounted on the patient litter support structure 19 as is shown in FIGS. 1 and 4. The patient litter includes a pair of longitudinally extending side members 142 and 143 connected respectively to the brackets 41 and 42 and by means of fasteners 144 to the axle member 26 at the head end of the patient litter support structure 19. Conventional fasteners are utilized to effect the connection of the side members 142 and 143 to the brackets 41 and 42. A handle construction 146 interconnects the side members 142 and 143 at the foot end of the ambulance cot. Conventional hand grips 148 are provided as needed. In this particular embodiment, a further handle construction 147 is mounted to a pair of side members 151 and 152 that are pivotally connected by the fasteners 144 to the axle member 126 at the head end of the patient litter support structure 19. This pivotal support enables the handle construction 147 to be dropped downwardly about the pivot axis defined by the fasteners 144 so that the handle structure 147 will dangle in a vertically aligned orientation out of the way directly below the fasteners 144. A set of fixed and non-casterable wheels 153 are provided on each of the head ends of the side members 151 and 152. In the position of the ambulance cot illustrated in FIGS. 1 and 4, the wheels 153 are the ones that first engage the floor of the interior of the emergency vehicle as the ambulance cot is being inserted into the interior of the emergency vehicle. A conventional latch bar 154 is provided which, when moved, effects a release of a latch (not illustrated) to enable the side frame members 151 and 152 at the head end of the patient litter to pivot downwardly about the pivot axis defined by the fasteners 144.

A handle 156 (FIG. 12) is mounted pivotally as at 157 to a crosswise extending bracket 158 to a not illustrated bracket connected to the side member 151. The handle 156 is connected as at 158 to the free end of the chain-like member 98 to enable the chain 98 to be selectively tensioned in response to pivotal movement of the handle member 156 about the pivot axis 157 therefor.

Similarly, a further handle 161 is pivotally secured to a bracket 162 oriented at the foot end of the ambulance cot adjacent the handle 132 of the additional control mechanism 116. The handle 161 is pivotally connected as at 163 to the elongate chain 113 so that pivotal movement of the handle 161 in a counterclockwise direction will effect a tensioning of the chain 113 and a corresponding lengthwise and laterally inwardly movement of the elongate bar 89 as discussed above.

Other components of the patient litter 141 are conventional and will not be described in any detail. For example, the portion 165 of the patient litter supporting the legs is raiseable and lowerable about an axis of an axle member 164 and the fowler section 166 is pivotally secured to an axle member 167. A conventional gas spring 168 serves to resist rapid return movement of the fowler section from a raised location to the position illustrated in FIG. 1. In addition, conventional side rails 169 are provided along the lateral edges of the patient litter 141.

OPERATION

Although the operation of the ambulance cot described above will be understood from the foregoing description by skilled persons, a summary of such description is now given for convenience.

Figure 11:
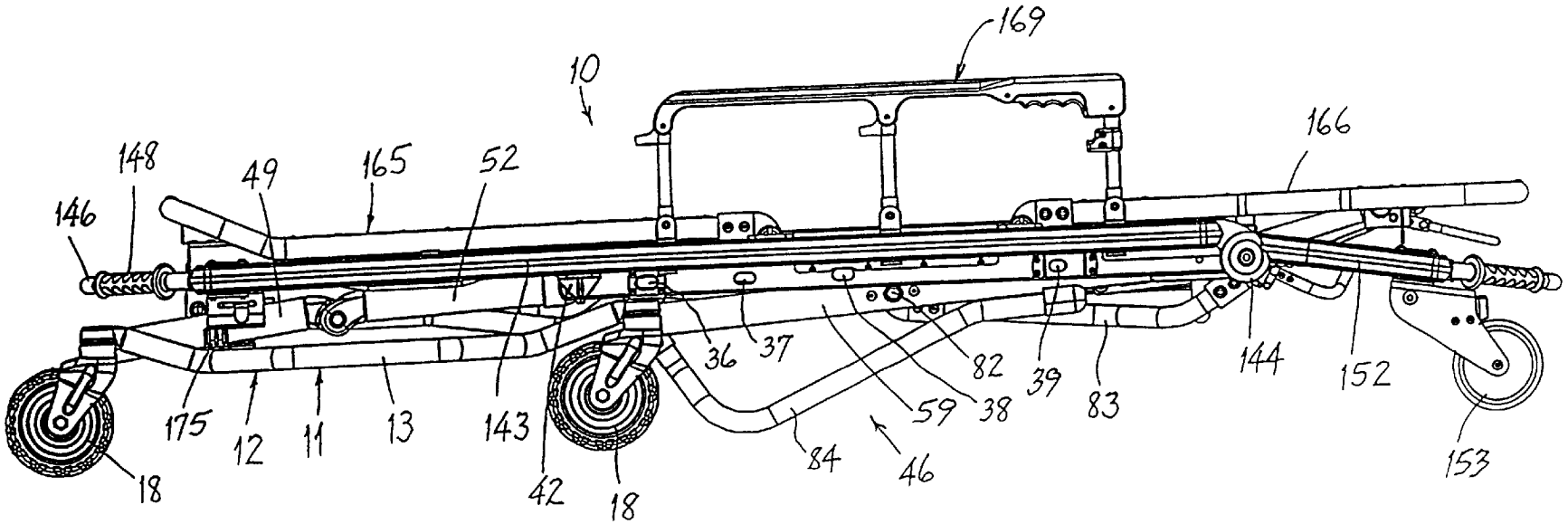
FIG. 11 is a side view of the ambulance cot in the folded position.

FIGS. 1, 2, 4, 9 and 10 illustrate the ambulance cot in the position known as the load position. When the phrase load position is utilized, this means that the ambulance cot is in a condition ready for insertion into the interior of the emergency vehicle. When the ambulance cot is in the load position, the reciprocal pins 67 and 67A are oriented and received in the aligned apertures 34 and 39. As stated above, the aperture 34 is an elongated slot (FIG. 2) extending forwardly from a position axially aligned with the aperture 39 to a terminal end shown schematically as at 171 in FIG. 2. In order to effect a loading of the ambulance cot into the emergency vehicle schematically illustrated in broken lines at 172 in FIG. 9, it is first necessary to pivot the handle 132 to the position illustrated in FIG. 7 so that tension is applied to the elongate chain-like member 131 to draw the elongate bar 117 leftwardly to cause the bracket 119 to pivot, unencumbered by the peg 139, about its pivot axis 121 to the position illustrated in FIG. 7 to orient the wheel 123 to the left of the ramp 128 to urge the elongate bar 89 to the broken line position illustrated in FIG. 7. Thereafter, the ambulance cot 10 can be moved forwardly to the position illustrated in FIG. 9 wherein the leading wheels 153 are oriented in a location above the interior floor surface 173 of the emergency vehicle 171 and the bumpers 84 come into contact with an exterior surface component 174 of the emergency vehicle 172. Thereafter, the handle 161 is pivoted by one attendant lifting the foot end of the cot about the axis upon which it is supported to effect a tensioning of the elongate chain-like member 113 to cause the elongate bar 89 to be moved leftwardly as well as further laterally inwardly toward the longitudinal centerline of the ambulance cot 10 to move the elongate bar 89 into contact with the wheel 74A thereby causing, through the connection of the peg 73A connecting the wheel 74A to the reciprocal pin 67A, a movement of the pin 67A out of the aperture 39. Since the pin 67 is oriented in an elongate slot 34, movement of the ambulance cot 10 to the right (FIG. 9) will cause the support mechanism 46 to move counterclockwise about the axis of the axles 24 and 26 and a corresponding sliding movement of the pin 67 in the elongate slot 34 toward the terminal end 171. As is schematically illustrated in FIG. 2, a tension spring 176 is provided and is connected at one end to the side frame member 22 and at the other end to an abutment member 177 schematically illustrated in FIG. 2 that is engaged by the bracket 61 supporting the wheels 62 to urge the abutment 177 toward the terminal end 171 of the elongate slot 34 to effect a tensioning of the spring 176. It is preferably that the bracket 61 be allowed to travel approximately ½" to 1" before engagement with the abutment 177 occurs. During the sliding movement of the pin 67 in the elongate slot 34, the support mechanism 46 collapses to the position illustrated in FIGS. 11 and 12. This position is known as the folded position, namely, a position that the cot is normally in when it is inside the emergency vehicle with all wheels 18 and 153 resting on the floor surface 173 inside the emergency vehicle 172. Stops 175 are provided for limiting the collapsing movement as shown in FIG. 11.

As the ambulance cot 10 is moved from inside the vehicle to a position located outside the vehicle, the tension spring 176 will cause the slide mechanism defined by the sleeves 66 and 66A and interconnecting yoke 79 to be pulled from the position illustrated in FIG. 8 to the position illustrated in FIG. 2 thereby causing the support mechanism 46 to drop downwardly so that the wheels 18 will come into contact with the ground. Further, the pin 67 will strike the rearward end of the elongate slot 34 and the pin 67A will be urged into the aligned aperture 39 by the spring 69A.

It should be pointed out that when the additional control mechanism 116 has been activated to move the wheel 123 into the position illustrated in FIG. 7, manual activation of the handle 161 causing a tensioning of the chain 113 and a leftward movement of the elongate bar 89 to occur, the ramp 128 will also be shifted to the left past the wheel 123 while the pin 67A is being withdrawn from the aperture 39. Upon a release of the handle 161, it will be returned to the original position thereof by the return springs 114. The spring 126 will urge the elongate bar 117, wheel 123 and the handle 132 back to the original positions thereof illustrated in FIGS. 5 and 6 to reset the control mechanism 116. Thus, and when the cot 10 is in the load position, it will not be possible to reactivate the pin 67A to withdraw it from the aperture 39 until the handle 132 is again moved to the position illustrated in FIG. 7. This means that the ambulance attendant cannot inadvertently move the handle to the position illustrated in FIG. 7 and then, through some other emergency activity, forget that the handle 132 has been so shifted to cause an inadvertent collapsing of the entire support mechanism 46 to the folded position illustrated in FIG. 11 immediately upon activation of the handle 161. The fact that the ambulance attendant has released his or her grip on the handle 161, after having pivoted the handle 161, will immediately cause the handle 132 to return to the reset position illustrated in FIGS. 6 and 8.

When it is desired to lower the patient litter elevation from the load position to positions intermediate the folded position and the load position, the handle 132 will require shifting from the position illustrated in FIGS. 6 and 8 to the position illustrated in FIG. 7 to enable the bar 89 to retract the pin 67A from the aperture 39 in response to a pivotal movement of the handle 161. In addition, it will be necessary to pivot the handle 156 by a second emergency vehicle attendant to enable the elongate bar 88 to retract the pin 67 from the elongate aperture 34. Thereafter, both ambulance attendants can then allow the patient litter to be lowered to a first position illustrated in FIG. 13 beneath the load position. A release of the handle 161 will allow the return springs 114 and 114A to cause the ramp 128 to urge the wheel 123 back to the original reset position thereof illustrated in FIG. 6 and the handle to the position also illustrated in FIG. 6.

A further tensioning spring 178 is schematically illustrated in FIG. 2 and is connected at one end to the axle member 24. The other end of the spring 178 extends 180° around a pulley 179 to a terminal end whereat there is connected an abutment 181 that is engaged by a bracket 182 provided on the sleeve 66A. The bracket 182 is preferably allowed to travel about ½" to 1" before it contacts the abutment 181 to begin tensioning the spring 178 as the abutment 181 is moved toward the broken line position thereof as illustrated in FIG. 2. As a result, when the attendants lift the patient litter 141, the springs 178 and 176 will serve to force an orientation of the pins 67 and 67A into alignment with the load position apertures 34 and 39, namely, a neutral position between the effective regions of the springs 176 and 178.

Figure 13:
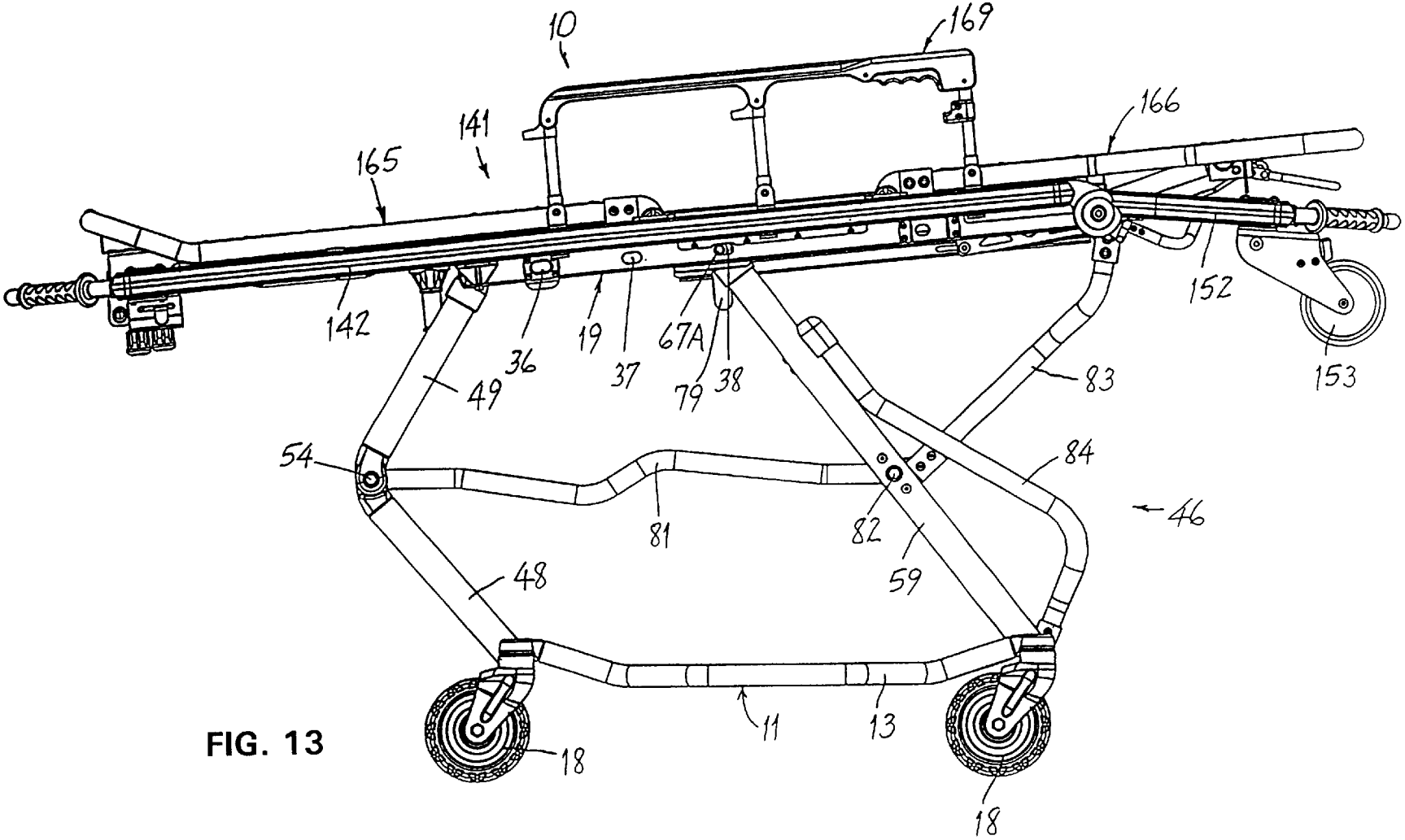
FIG. 13 is a side view of the ambulance cot in a first position below the transport position illustrated in FIG. 9.
Figure 14:
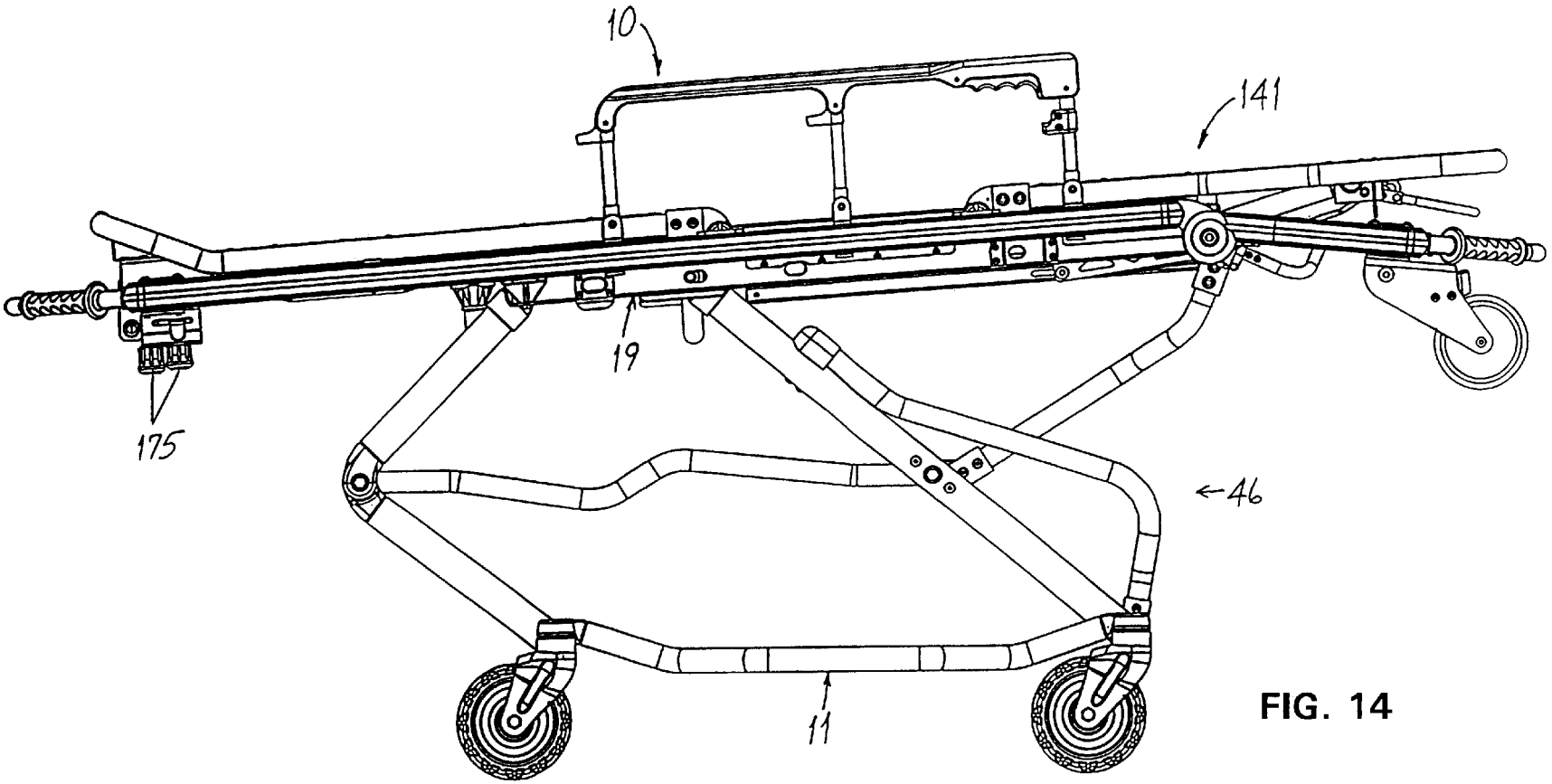
FIG. 14 is a side view of the ambulance cot in a second position below the transport position illustrated in FIG. 9.
Figure 15:
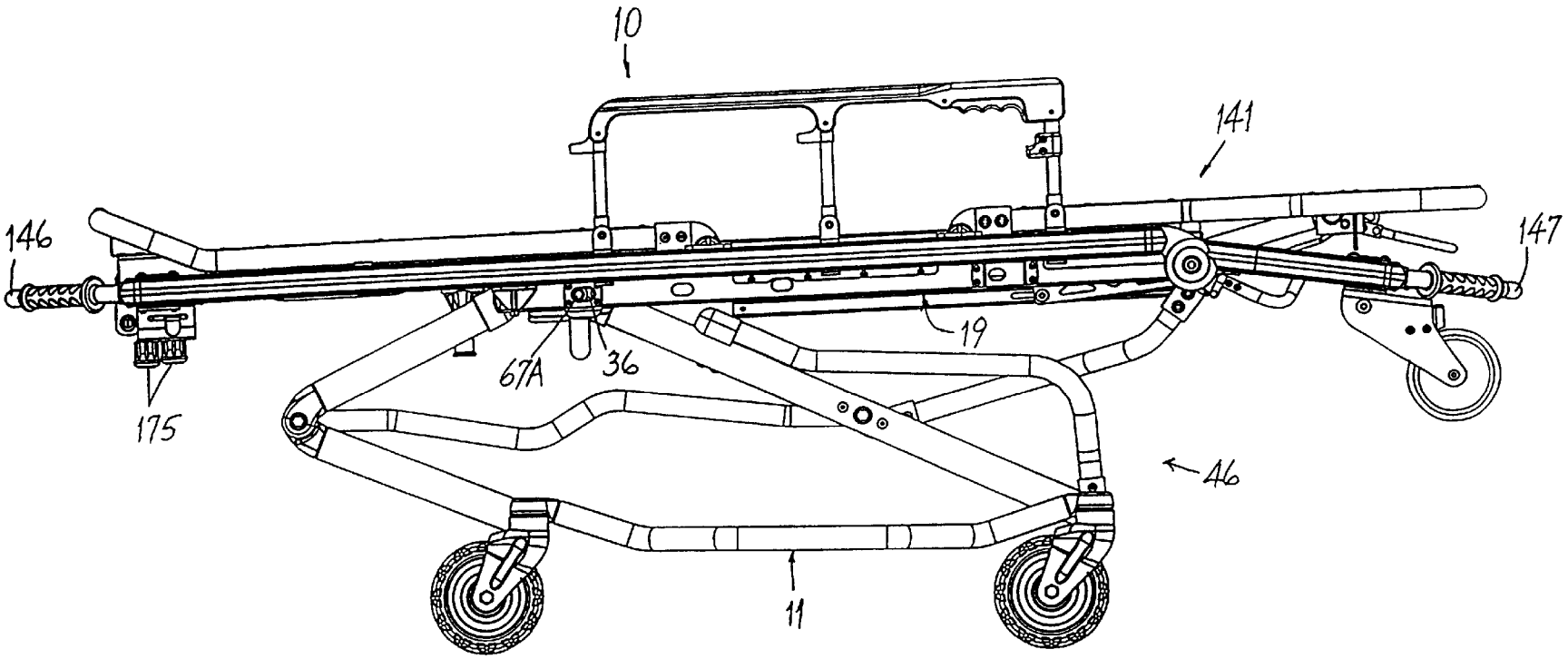
FIG. 15 is a side view of the ambulance cot in a third position below the transport position illustrated in FIG. 9.

With the ambulance cot in the position illustrated in FIG. 13, the aligned sleeves 66 and 66A and interconnecting yoke 79 are now oriented in alignment with a portion of the elongate bar 89 that has a width W1. Since the elongate bar 89 can now engage the wheel 74A during its stroke without activation of the handle 132, further manipulative raising and lowering of the ambulance cot 10 when it is in this position or the next lower positions will not require an activation of the handle 132. In any event, it will not be possible to pivot the handle 132 because the plate 136 will be in a position causing the peg 139 thereon to enter the notch 140 to lock the bracket 119 to the plate 136. In the position illustrated in FIG. 13, the reciprocal pins 67 and 67A are received in axially aligned apertures 33 and 38. Two more lower positions of the ambulance cot 10 are illustrated, respectively, in FIGS. 14 and 15, FIG. 14 representing the position wherein the reciprocal pins 67 and 67A are received in axially aligned apertures 32 and 37 and FIG. 15 representing the location whereat the reciprocal pins 67 and 67A are received in axially aligned apertures 32 and 36.

ALTERNATE CONSTRUCTION

In the preceding embodiment, two handles 156 and 161 are employed to effect a lowering of the patient litter elevation from the load position to positions intermediate the folded position and the load position. This embodiment employs just one handle for accomplishing the same task.

Figure 16:
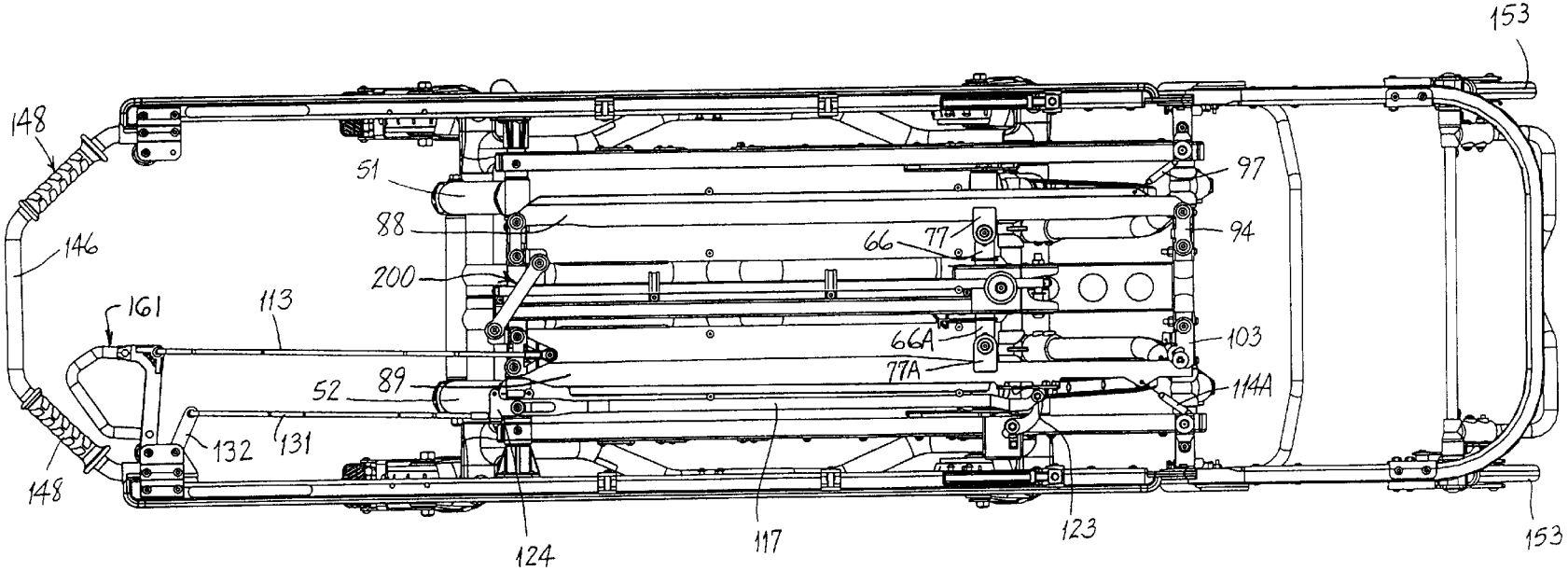
FIG. 16 is a top plan view of an alternate construction.
Figure 17:
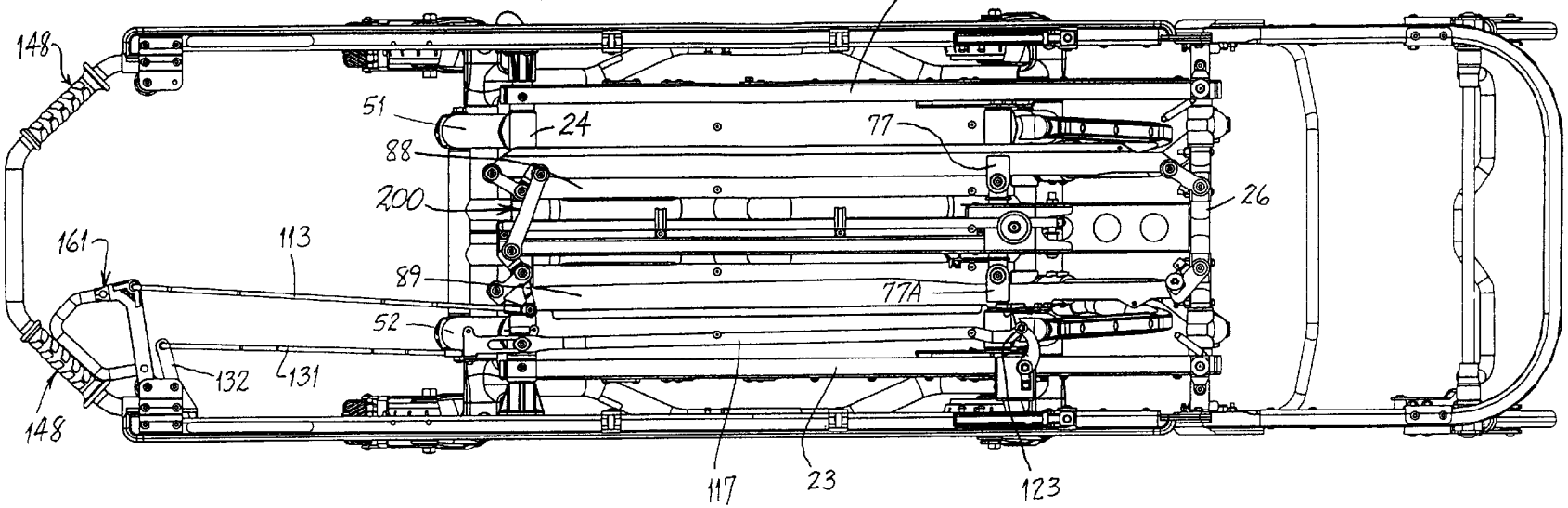
FIG. 17 is a top plan view like FIG. 16, but with the components shifted to a second position thereof.

More specifically, the handle 156 and chain 98 are deleted. However, the elongate bar 88 formerly associated with the handle 156 is retained (see FIG. 16) and is now linked by two sets of linkage mechanisms 200 located at opposite ends of the bar 88 to the opposite ends of the elongate bar 89 so that when the handle 161 is operated, the movement of the handle 161 is translated into a leftward (FIG. 16) movement of the elongate bar 89 and, through operation of the linkage mechanisms 200, a leftward movement of the elongate bar 88 as shown in FIG. 17 to effect, as with the preceding embodiment, a retraction of the pins 67 and 67A from the respective sets of aligned recesses 31, 36; 32, 37; 33, 38 and from the elongate recess 34.

Figure 18:
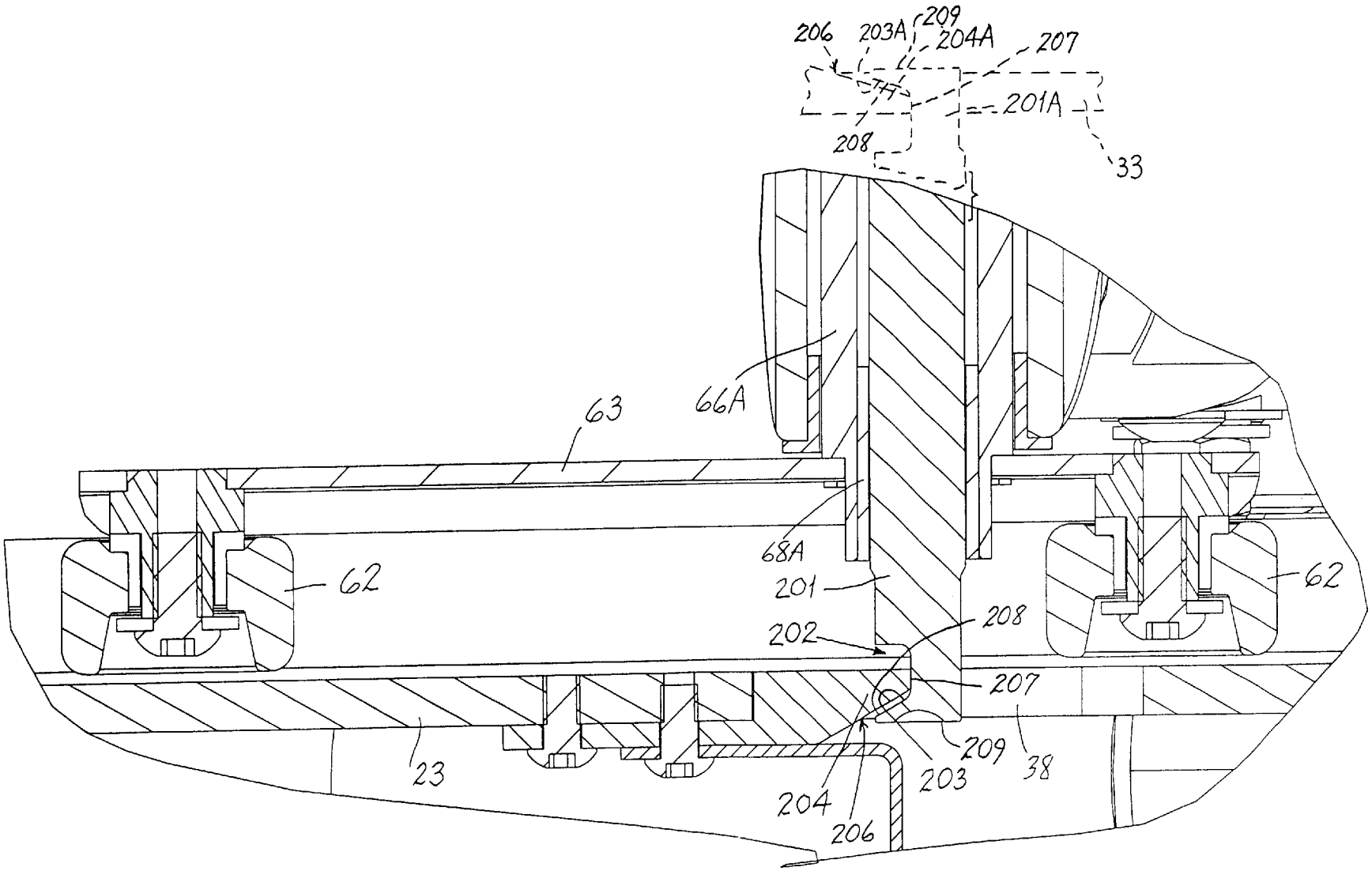
FIG. 18 is an enlarged fragmentary sectional view of a modified pin latch in a first position thereof.
Figure 19:
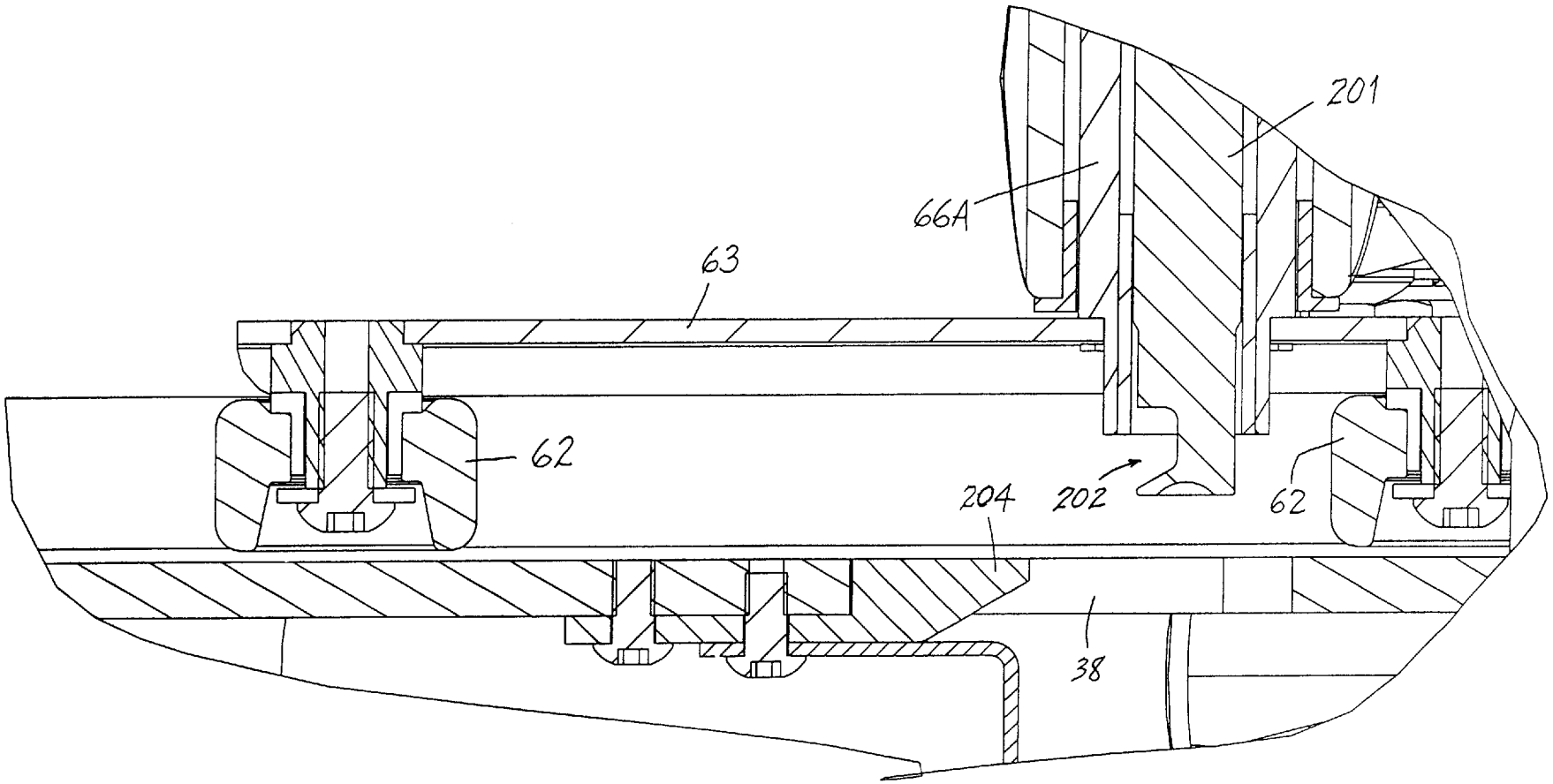
FIG. 19 is a view like FIG. 18, but in a second position thereof.
Figure 20:
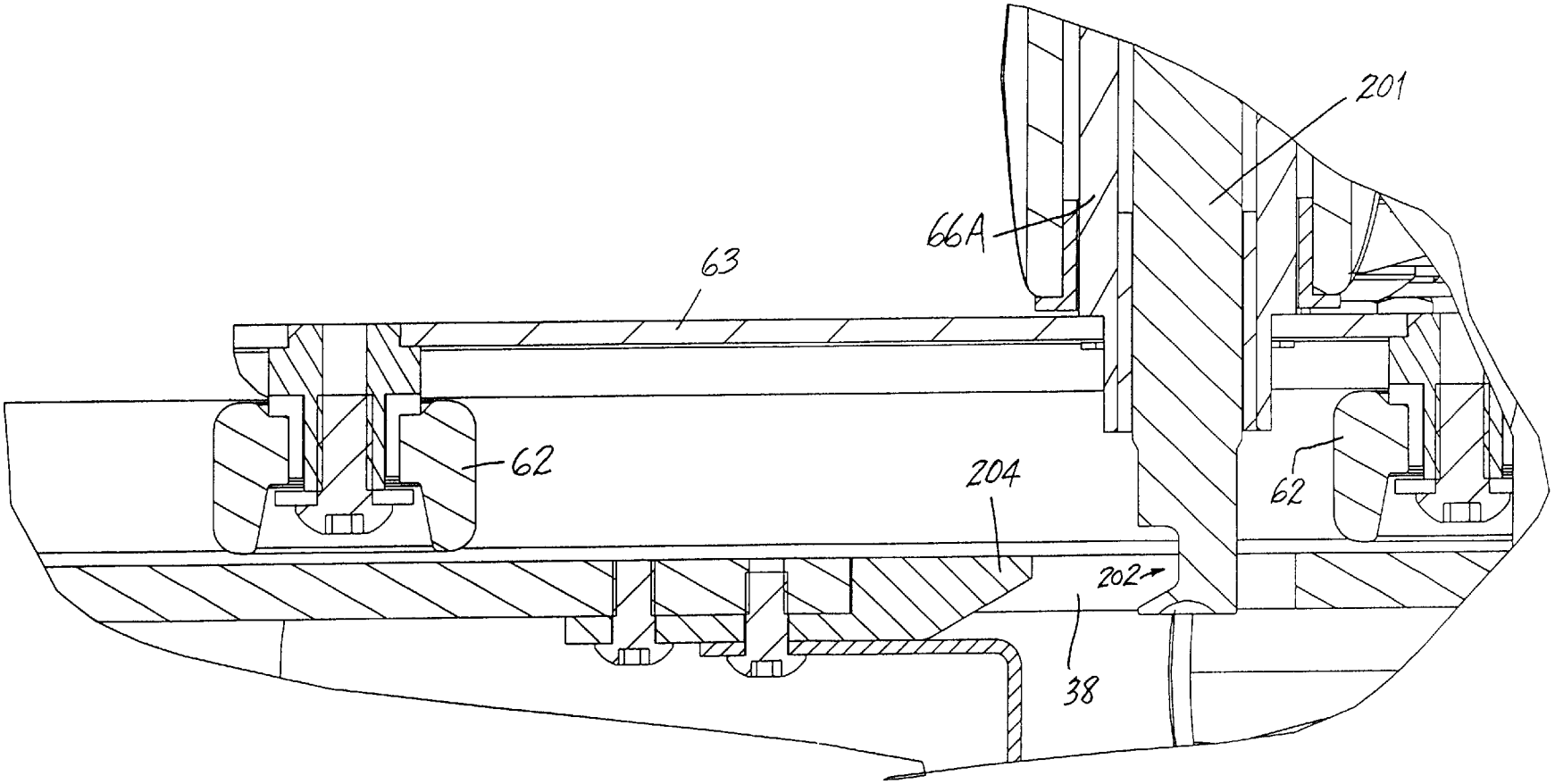
FIG. 20 is a view like FIG. 18, but in a third position thereof.

Also in the alternate construction, the identical pins 67 and 67A are each replaced with identical pins 201 and 201A respectively, only the pin 201, corresponding to the pin 67 in the previous embodiment, being illustrated in FIGS. 18–20. As is shown in FIGS. 18–20, the pins 201 and 201A each have a section 202 and 202A of reduced diameter thereby defining at each location a notch 203 and 203A, into which notches is received edges 204 and 204A of a respective aperture, here apertures 38 and 33. In this embodiment, the edges 204 and 204A are each tapered as at 206 so that they are reduced in thickness as at 207. A wall 208 of each of the notches 202 and 202A closest to distal ends 209 of the pins 201 and 201A is tapered thereat to conform to the taper 206 on the edges 204 and 204A. As a result, a simple operation of first the handle 132 followed by an operation of the handle 161 will be unsuccessful in retracting both pins 201 and 201A because the respective tapered surfaces 206 and 208 will engage one another.

However, when the lever 132 is operated and thereafter the two attendants simultaneously lift the foot and head ends of the patient litter 141 at the handles 146 and 147, respectively, to remove the wheels 18 from engagement with the ground, the weight of the wheeled base 11 and the manner in which the vertical legs 58, 59 and 48, 49, 51, 52 are linked to the patient litter support structure 19 and to each other will cause the upper ends of the vertical legs 58, 59 and the wheel supporting brackets 61 and 63 connected thereto to both shift toward the head end (to the right in FIGS. 18 to 20) to displace rightwardly the pin 201 (also the pin 201A) from the edges 204 and 204A of the opening 38 and 33 as the pin 201 is shown in FIG. 19. Thereafter, the attendant at the foot end of the ambulance cot 10 can activate the handle 161 to effect a retraction of the pin 201 and through the linkage mechanisms 200 the pin 201A from the respective apertures 38 and 33 as shown in FIG. 20.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An ambulance cot comprising:

an upper frame forming a bed having a head end and a foot end;

a lower frame;

wheels supported on said lower frame;

front and rear vertical legs connecting said upper frame to said lower frame with said lower frame approximately centered below said upper frame, at least one longitudinal beam supported on said upper frame, a front slide slidably mounted on said at least one beam and pivotally connected to an upper end of said front legs, an upper end of said rear legs being pivotally mounted on said at least one beam;

locking means releasably and selectively locking said front slide in selected longitudinal positions on said at least one beam to adjust the positions of said upper frame with respect to said lower frame, said locking means including at least one locking pin slidably mounted on said front slide for movement toward and away from said at least one beam, a spring urging said at least one pin toward said at least one beam, stops on said at least one beam engageable by said at least one locking pin to position the upper ends of said front legs in selected positions, an elongate release bar mounted by pivoted arms to said upper frame and being supported for lateral movement in response to a longitudinal force applied thereto through a handle fastened thereto, said release bar being engageable with said at least one pin to effect a movement of said at least one pin away from said at least one beam and a withdrawal of said at least one pin from said stops in response to said lateral movement of said release bar, and said at least one pin having a catch thereon, said catch being configured to normally engage said stop to block withdrawal of said at least one pin from said stop when said release bar is moved longitudinally.

2. The ambulance cot according to claim 1, wherein each of said stops is an elongate opening in said at least one beam, said elongate opening being elongated along a longitudinal length of said at least one beam, said at least one pin normally being oriented adjacent one end of said elongate opening so that said catch will be normally positioned to engage a first of said edges of said elongate opening.

3. The ambulance cot according to claim 2, wherein said at least one pin is configured to move from said first edge toward a second of said edges oriented at an opposite end of an elongate opening in response to a lifting force being applied to one of said head end and said foot end of said upper frame to thereby facilitate withdrawal of said at least one pin from said elongate opening by operation of said release bar.

4. The ambulance cot according to claim 3, wherein said catch is defined by a reduced diameter section in said at least one pin oriented adjacent a distal end thereof, said reduced diameter section having a finite depth and a finite width to accommodate therein a section of said first edge to thereby prevent withdrawal of said at least one pin.

5. The ambulance cot according to claim 3, wherein said length of said elongate opening is greater than a cross sectional dimension of said at least one pin whereat said reduced diameter section is located.

6. The ambulance cot according to claim 3, wherein said locking means additionally includes control means configured on said front and rear vertical legs to effect a displacement of said at least one pin from said first edge to said second edge only in response to a lifting force being applied to both of said head end and said foot end of said upper frame sufficient to remove a majority of the load from said wheels.

7. The ambulance cot according to claim 6, wherein said upper frame has on an underside adjacent a head end thereof an entry wheel which, upon a resting of said entry wheel on a surface of an emergency vehicle, effects a supporting of said head end of said upper frame so that a lifting of said foot end by one attendant will be sufficient to remove a majority of the load from said wheels.

* * * * *